United States Patent [19]

Baker et al.

[11] Patent Number: 4,948,209

[45] Date of Patent: Aug. 14, 1990

[54] VSCF STARTER/GENERATOR SYSTEMS

[75] Inventors: Donal E. Baker, American Township, Allen County; Jack W. Ogden, Fort Shawnee, both of Ohio

[73] Assignee: Westinghouse Electric Corp., Pittsburgh, Pa.

[21] Appl. No.: 304,620

[22] Filed: Jan. 1, 1989

[51] Int. Cl.[5] ..... F02N 11/04; F02N 11/08

[52] U.S. Cl. ..... 322/10; 290/38 R; 290/46; 322/29

[58] Field of Search ..... 322/10, 11, 28, 29, 322/32, 40; 290/38, 46 R

[56] References Cited

U.S. PATENT DOCUMENTS

| | | | |
|---|---|---|---|
| 3,191,116 | 6/1965 | Depenbrock | 322/10 |
| 4,119,861 | 10/1978 | Gocho | 322/32 X |
| 4,481,459 | 11/1984 | Mehl et al. | 322/29 X |
| 4,574,340 | 3/1986 | Baker | 363/41 |
| 4,728,806 | 3/1988 | Baker et al. | 307/43 |
| 4,808,842 | 2/1989 | Hughes | 322/40 X |
| 4,841,216 | 6/1989 | Okada et al. | 322/10 |

*Primary Examiner*—R. J. Hickey

*Attorney, Agent, or Firm*—R. P. Lenart

[57] ABSTRACT

A variable speed, constant frequency starter generator system is provided with a dynamoelectric machine, electrically connected to a multiple-phase bus and pair of multiple-phase rectifiers for producing a DC voltage on a pair of link conductors. An inverter converts the DC voltage to floating AC voltage which is further converted to a ground-referenced AC voltage by a transformer. During generator operation, the output voltage of the machine is rectified by at least one of the rectifiers to produce a DC voltage on the link conductors which is converted to a constant frequency AC voltage by the inverter. During starter operation, an externally supplied AC voltage is applied to the transformer. The transformer converts the externally applied AC voltage to a pair of phase-displaced AC voltages which are rectified by the pair of multiple phase rectifiers to produce twelve-pulse rectified DC voltage on the link conductors. This reduces the harmonic content of the current supplied by the external power source. In another embodiment, a third multiple phase rectifier performs the function of rectifying the output voltage of the machine to produce a six pulse DC voltage on the link conductors for generator operation.

14 Claims, 5 Drawing Sheets

FIG. 5
PRIOR ART
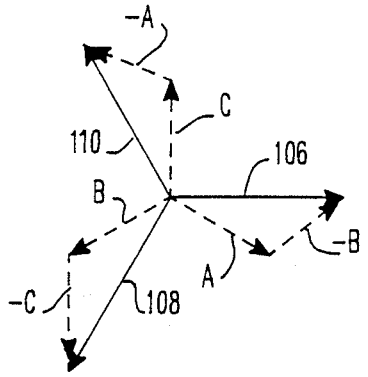
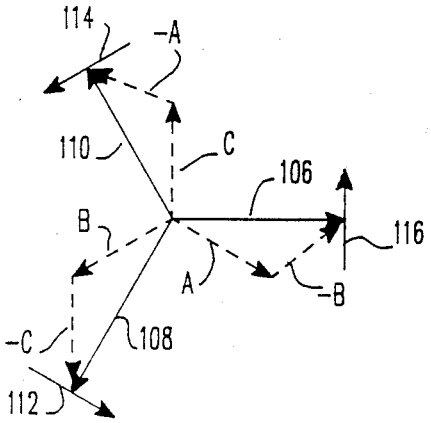
FIG. 6
FIG. 7
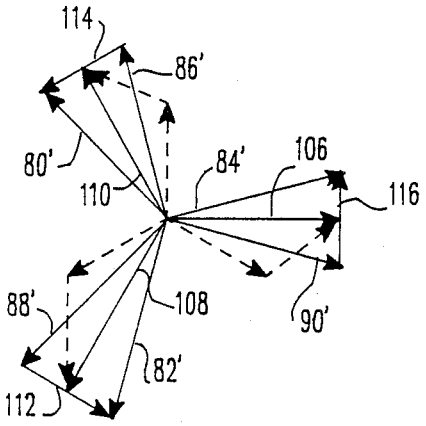

VSCF STARTER/GENERATOR SYSTEMS

BACKGROUND OF THE INVENTION

This invention relates to variable speed constant frequency (VSCF) electric power systems and, more particularly, to such systems which provide both starter and generator functions.

In airborne electrical power generation systems, it is desirable to have a single system which provides both the starter and generator functions. The weight savings on an airplane can be substantial when a dedicated starter is eliminated. For this reason, electrical power systems which are capable of providing engine start functions can provide both cost and weight savings.

Variable speed constant frequency power generation systems are commonly used for aircraft applications. One type of VSCF system includes a variable speed generator which supplies DC power to a pair of DC link conductors. An inverter circuit receives DC power from the link conductors and produces a constant frequency AC output. The inherent simplicity and reliability of DC link variable speed constant frequency systems has been established and it is desirable to modify the existing designs to provide starter capability.

When a VSCF power system operates as an engine starter, the electronic power converter is reversed via power contactors so that it derives its input power from a utility power bus and delivers power to the generator which in turn operates as a motor. The electronic converter typically includes a three-phase rectifier and a DC to AC inverter. The rectifier receives power from the line and feeds it to the inverter. Thus, the power drawn from the utility bus is characteristic of a three-phase full-wave rectifier circuit. The currents for such a rectifier are known to be high in harmonic content, i.e., 20% of the fifth harmonic, 14% of the seventh, 9% of the eleventh, 8% of the thirteenth, and so on.

A filter of proper design could be added to the system which would reduce the harmonic currents to acceptable levels; however, such a filter will necessarily add substantial weight to the system because it must be designed around the lowest harmonic (20% of the fifth harmonic). For example, a 60/75 kVA system would require a filter weighing approximately 30 pounds, or about one-third of the total generator system weight. Another disadvantage of a large filter is the leading power factor which it presents to the system. If the aircraft is powered by a conventional constant speed generator (for example, a ground power cart), then this large leading power factor load will cause the generator to self-excite, go to ceiling voltage, and damage the electrical system. Such an approach is not practical.

It is therefore desirable to design a VSCF starter/-generator system in which the size of the required starter filter can be reduced.

SUMMARY OF THE INVENTION

This invention provides a variable speed, constant frequency starter/generator system which includes a dynamoelectric machine which is electrically connected to a multiple phase bus, a pair of multiple phase rectifiers which are connected to a pair of DC link conductors, and an inverter for inverting a DC voltage on the link conductors to a floating multiple phase AC voltage on a second multiple phase bus. A transformer is provided for converting the floating multiple phase AC voltage on the second bus to a ground-referenced, multiple phase AC voltage, when the system is operated in the generate mode, and for converting an externally supplied multiple phase AC voltage to a pair of phase displaced three-phase voltages when the system is operated in the starter mode. Switching devices are provided for alternatively connecting the machine power bus to at least one of the multiple phase rectifiers for generator operation of the machine and for connecting the machine power bus to the second multiple phase bus for starter operation of the machine. Switching devices are further provided for alternatively connecting the transformer to the second multiple phase bus for generator operation of the machine or for connecting the two phase displaced three-phase voltages to the rectifiers for starter operation of the machine.

This invention also encompasses a method for operating the above-described variable speed, constant frequency start/generator system. By using a pair of multiple phase rectifiers in combination with a pair of phase displaced multiple phase voltages to provide the DC link voltage during starter operation, the size of the required starter filter is significantly reduced.

BRIEF DESCRIPTION OF THE DRAWINGS

The invention will become more readily apparent from the following description of the preferred embodiments thereof, shown by way of example only, in the accompanying drawings wherein:

FIG. 5 is a vector diagram which illustrates the voltages present on a typical neutral-forming transformer; and FIGS. 6, 7, 8, and 9 are vector diagrams which illustrate voltages present in neutral-forming transformers which have been modified for use in the starter/generator systems of this invention.

DESCRIPTION OF THE PREFERRED EMBODIMENTS

Figure 1:
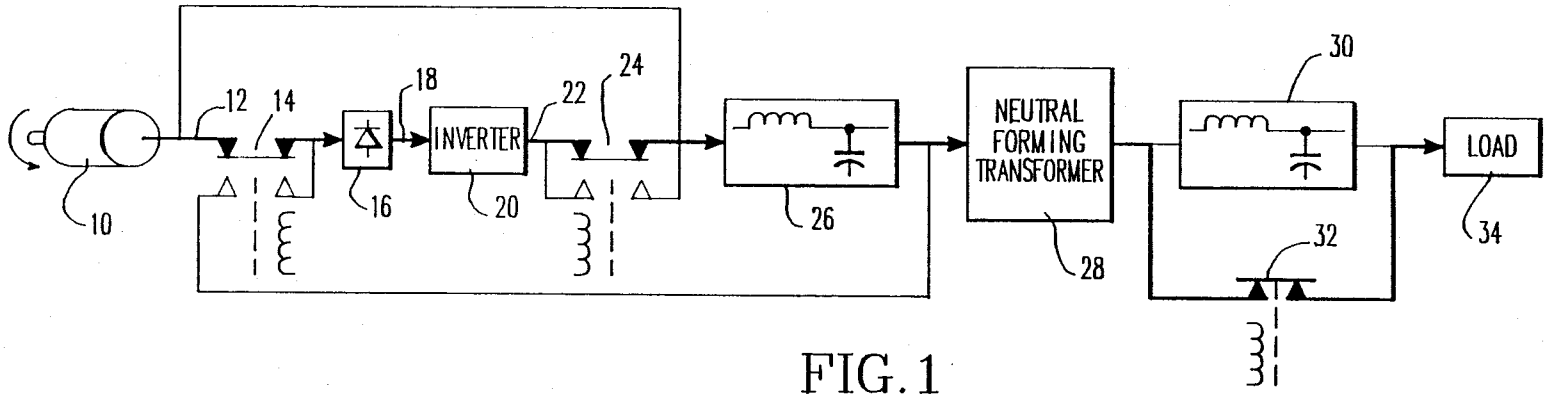
FIGS. 1 and 2 are block diagrams of VSCF starter/-generator systems which may be constructed in accordance with the present invention.
Figure 2:
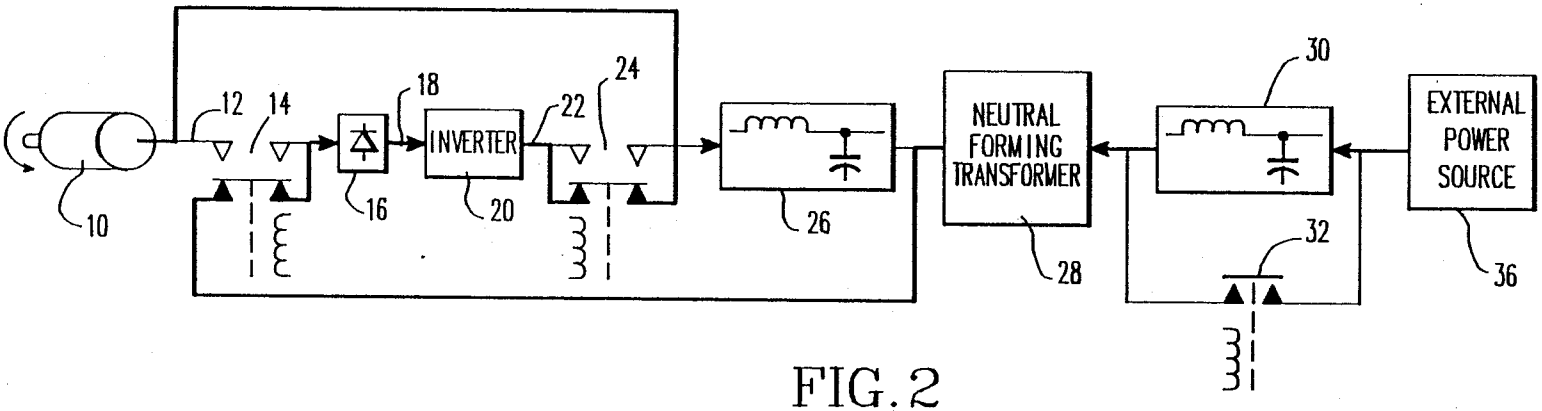

Referring to the drawings, FIGS. 1 and 2 are block diagrams of VSCF starter/generator systems which may be constructed in accordance with the present invention. In each of these figures, the direction of power flow is illustrated by heavy lines. In FIG. 1, the system is being operated in the generate mode. A dynamoelectric machine 10, which may be, for example, a synchronous generator, is driven by an external prime mover, not shown, such as an aircraft engine. A first multiple phase power bus 12 which is connected to the machine 10 is connected by way of contactor 14 to a multiple phase bridge rectifier 16. This creates a DC voltage on a pair of DC link conductors 18. An inverter 20 converts the DC voltage on the link conductors to a constant frequency AC voltage on a second multiple phase power bus 22. The floating voltage on bus 22 is connected to a filter 26 and a neutral-forming transformer 28, which converts it to a ground-referenced AC output voltage. A starter filter 30 is bypassed by the contacts of contactor 32 so that the ground-referenced AC voltage is delivered to a load 34.

FIG. 2 illustrates the system of FIG. 1 which has been reconfigured to operate in the starter mode. In FIG. 2, an external power source, which may be, for example, a utility bus or a ground power cart, is connected to the starter filter 30 and delivered to the neutral-forming transformer 28. Contactor 14 switches the output of the neutral-forming transformer to the rectifier 16 to produce the DC link voltage which is converted by inverter 20 to a controllable frequency AC output voltage on bus 22 in accordance with known techniques such as that illustrated in U.S. Pat. No. 4,574,340. Contactor 24 is used to connect the second multiple phase power bus 22 to the first multiple phase power bus 12 so that the machine 10 is driven as a motor to serve as a starter for an associated engine, not shown.

It is well known that the harmonic components and weight of the starter filter 30 will be greatly reduced if the rectifier which is used to produce the DC link voltage is changed from the typical six-pulse configuration to a twelve-pulse configuration. This is because the harmonic components for a twelve-pulse rectifier begin with the eleventh harmonic. The harmonic distribution will be 9% of the eleventh harmonic, 8% of the thirteenth, 4% of the twenty-third, 4% of the fifteenth, and so on. The filter needed to reduce these harmonics will be much smaller in size than that required for a six-pulse rectifier. Since the filter is smaller, the leading power factor is not a problem with respect to generator self-excitation in the external power source. To accomplish this, rectifiers used in the present invention require twelve diodes rather than the six used in typical existing VSCF converter rectifier assemblies. A twelve-pulse rectifier consists of two conventional six-pulse rectifiers which are fed by separate three-phase voltages. These two sets of three-phase voltages are shifted from each other by 30 degrees. Thus a phase-shifting, three-phase to six-phase transformer is needed to implement a twelve-pulse rectifier system. The added weight of a dedicated transformer to perform this function would again be excessive and may result in a system no lighter than a six-pulse, filtered approach.

Since present VSCF systems include a neutral-forming transformer, this invention presents a way in which this transformer can be modified to provide the desired 30 degree phase shift between the two sets of three-phase voltages as needed for the starter mode of operation. This results in a relatively low harmonic input current starter system, thereby reducing the size and weight of the required starter filter. Weight increases incurred in the VSCF generator system, by adding the starter function of this invention, are more than offset by the weight reduction achieved by removing the conventional dedicated starter from the engine.

Figure 3:
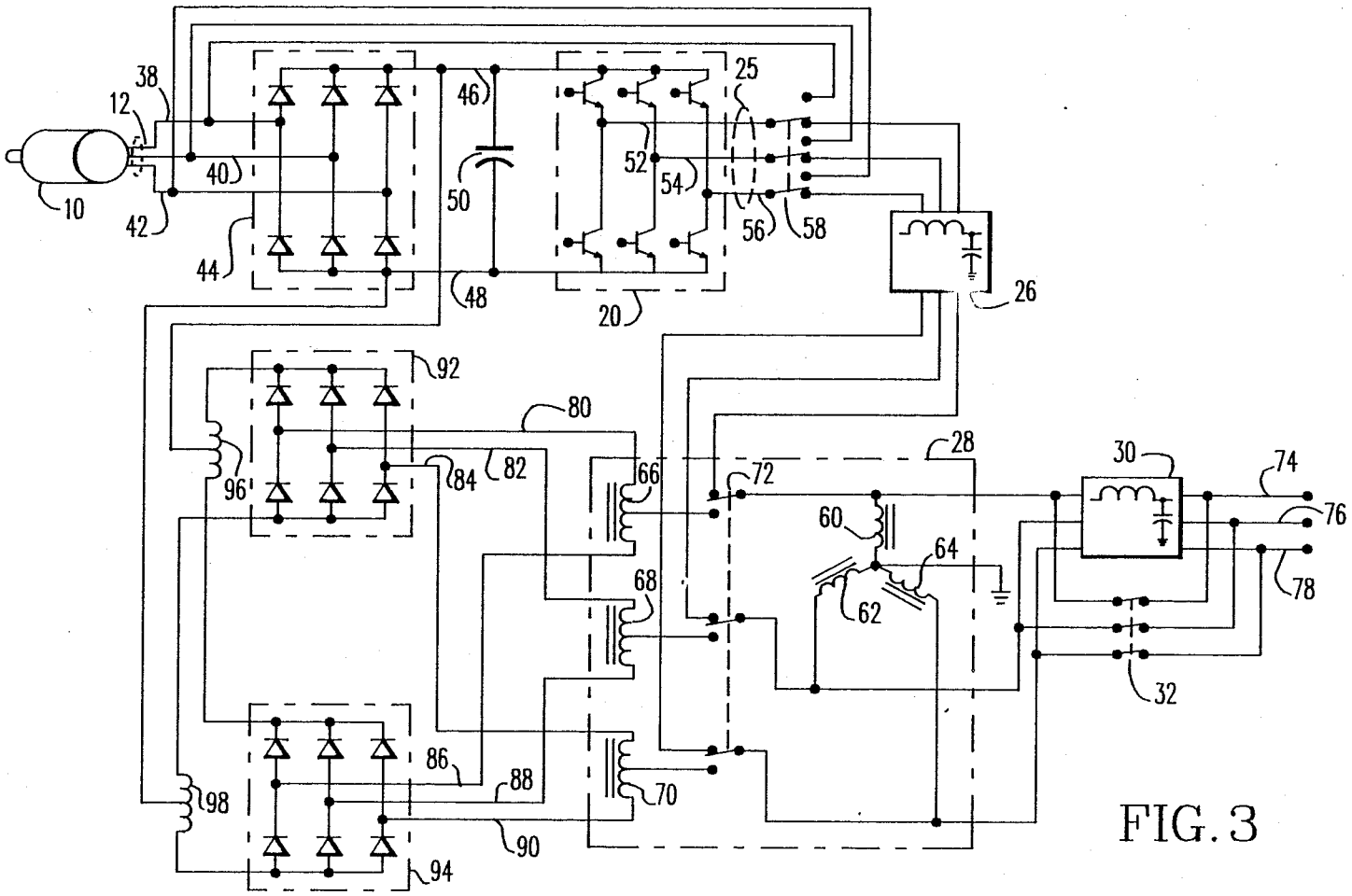
FIGS. 3 and 4 are schematic diagrams of alternative embodiments of the present invention.

FIG. 3 is a schematic diagram of a VSCF starter/generator system constructed in accordance with one embodiment of the present invention. In this embodiment, the dynamoelectric machine 10 is electrically connected to a first multiple phase power bus 12 comprising conductors 38, 40 and 42. Voltage on this power bus is rectified by a first three-phase bridge rectifier 44 to produce a DC voltage on a pair of DC link conductors 46 and 48. A filter capacitor 50 is connected across the DC link conductors. Inverter 20 is operated in accordance with known techniques to produce a constant frequency AC output on a second multiple phase power bus 25 comprising conductors 52, 54 and 56. Three switches 58, which may be the contacts of a contactor, are used to alternatively switch the second power bus to filter 26 during generator operation or to the first power bus during starter operation. The neutral-forming transformer 28 includes a first set of wye-connected coils 60, 62, and 64 for converting the floating AC voltage on the second power bus to a ground-referenced voltage, and a second set of center-tapped coils 66, 68, and 70. During the generate mode of operation, a second plurality of switches 72, which may be, for example, the contacts of a contactor, are used to connect the wye-connected coils of transformer 28 to the second power bus 25.

During starter operation, an external three-phase voltage is applied to lines 74, 76, and 78, and switches 72 are actuated to connect the center taps of coils 66, 68, and 70 to one end of coils 60, 62, and 64, respectively. Transformer 28 is wound such that this produces a first set of three-phase voltages on lines 80, 82, and 84, and a second set of three-phase voltages, phase-displaced from the first set by 30 electrical degrees, on lines 86, 88, and 90. The first set of phase-displaced voltages is rectified by bridge rectifier 92 while the second set of phase-displaced voltages is rectified by rectifier 94. Bridge rectifiers 92 and 94 are electrically connected to interphase transformers 96 and 98 to produce a twelve-pulse rectified DC voltage on the DC link conductors 46 and 48. Switches 58 are actuated to connect the output of inverter 20 to the machine 10 so that the machine can operate as a starter.

Figure 4:
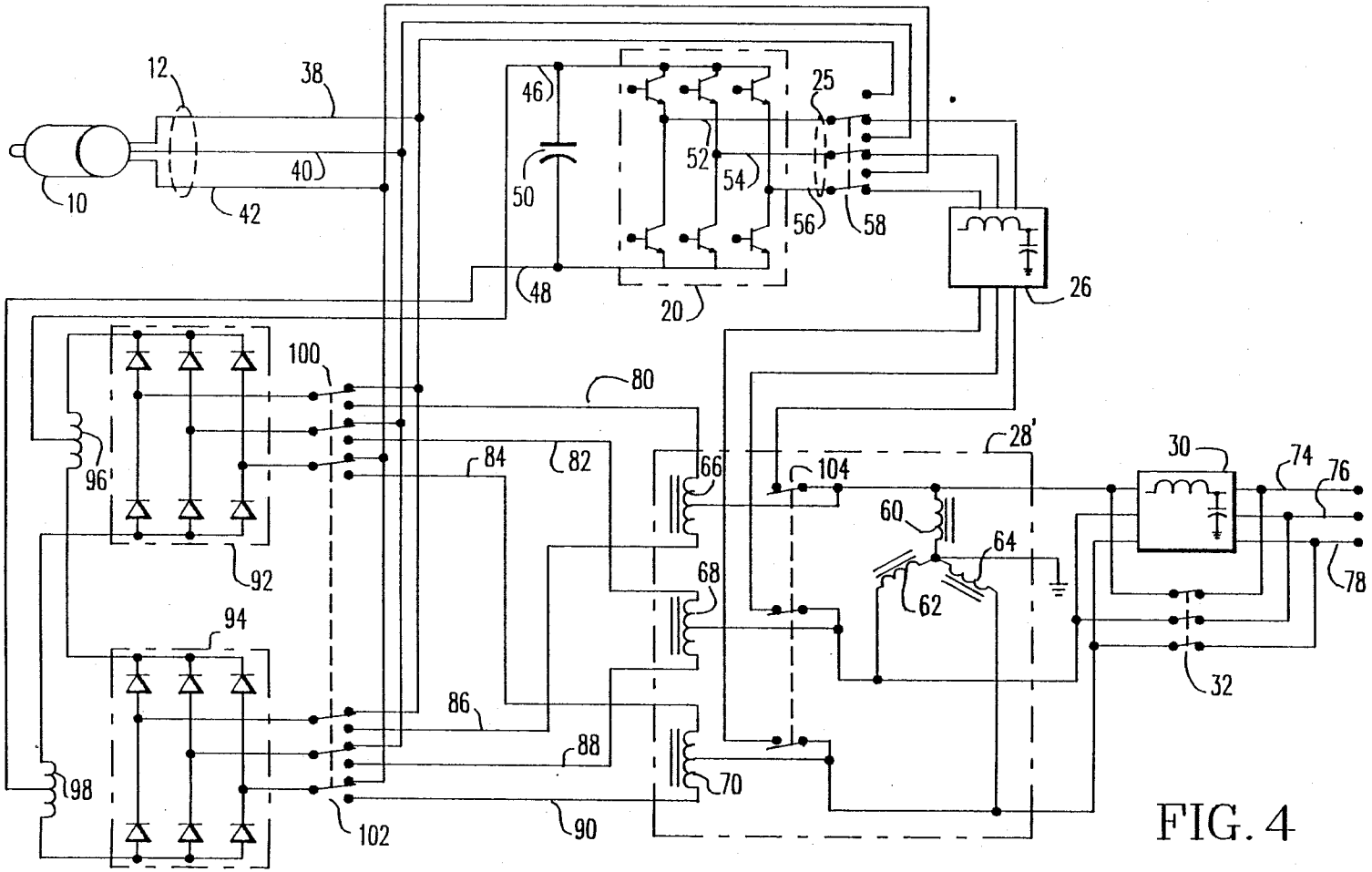

FIG. 4 is a schematic diagram of an alternative embodiment of the present invention. As in FIG. 3, all switches are shown in the position required for generator operation. The system of FIG. 4 provides a different switching arrangement to eliminate one of the bridge rectifiers required by the system of FIG. 3. In the FIG. 4 system, a first and second set of switches 100 and 102 are used to connect bridge rectifiers 92 and 94 to the first power bus 12 during generator operation or to the two sets of phase-displaced three-phase voltages on lines 80, 82, 84, 86, 88, and 90 during starter operation. Transformer 28' is wound so that center-tapped coils 66, 68, and 70 are permanently connected to one end of wye-connected coils 60, 62, and 64, respectively. Switches 104 are used to connect the output of filter 26 to the transformer 28' during generator operation. When all of the switches of FIG. 4 are operated to their alternate position, an externally supplied three-phase voltage on lines 74, 76, and 78 can be used to drive the machine 10 as a starting motor.

FIG. 5 is a vector diagram which illustrates how a typical DC link VSCF neutral-forming transformer is wound. This figure represents a so-called "zig-zag" transformer design which is popular because of its exceptionally good coupling between windings and thus low impedance. This vector diagram shows the applied line to neutral voltages as solid vectors 106, 108, and 110, while the voltages on each of the six windings are illustrated as dotted vectors A, −A, B, −B, C, and −C. Note that the parallel arrows (dotted) are wound on the same leg of the iron core of the transformer; thus a three-legged core is needed and used.

FIG. 6 is a vector diagram which illustrates one method of modifying the neutral-forming transformer of FIG. 5 by adding center-tapped windings 112, 114, and 116. Note that these new vectors are also parallel to existing zig-zag vectors in FIG. 5. Therefore, the added windings can be placed on the existing three-legged core.

FIG. 7 illustrate the final voltage vectors for the modified neutral-forming transformer. A first set of three-phase voltage 80', 82', and 84' would appear on lines 80, 82, and 84 of FIGS. 3 and 4 while a second set of three-phase AC voltages 86', 88', and 90' would be placed on lines 86, 88, and 90 of FIGS. 3 and 4. Note that the desired two sets of phase-displaced three-phase voltage vectors are shown on either side of the applied voltage vectors 106, 108, and 110, and that the added winding magnitude is sized precisely to provide the desired ±15 degree phase shift relative to the applied voltage. Also note that since the phase-shifting transformer is center-fed, the impedance on both phase-shifted windings is symmetrical. This is a necessary feature in twelve-pulse rectifier applications.

Figure 8:
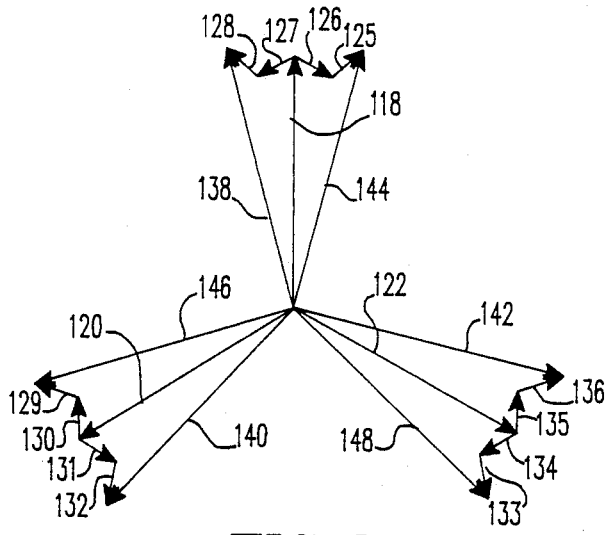
Figure 9:
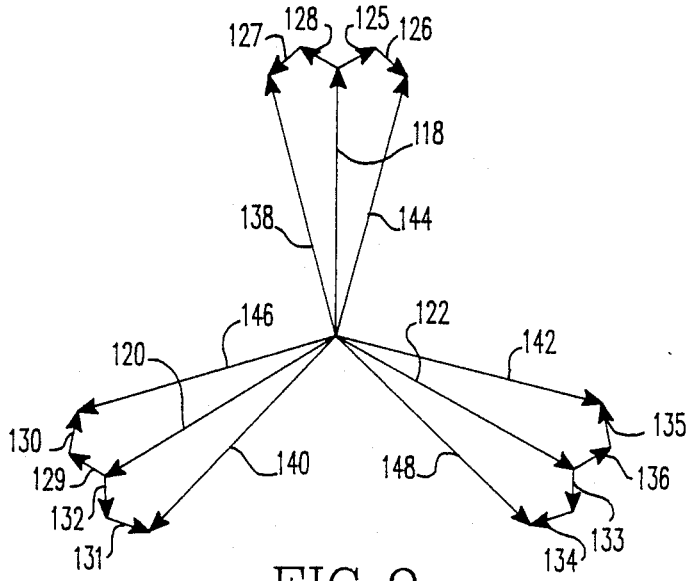

FIGS. 8 and 9 are vector diagrams which illustrate alternative transformer winding arrangements which may also be used in systems of this invention. In FIG. 8, vectors 118, 120, and 122 represent the applied voltages which are summed with voltages 124–136 to produce a first set of phase-displaced voltages 138, 140, and 142, and a second set of phase-displaced voltages 144, 146, and 148. FIG. 9 illustrates alternative connections of the same transformer as FIG. 8 to achieve the same result.

Although the present invention has been described in terms of what are at present believed to be its preferred embodiments, it will be apparent to those skilled in the art that various changes may be made without departing from the scope of the invention. It is therefore intended that the appended claims cover such changes.

What is claimed is:

1. A variable speed, constant frequency starter/generator system comprising:

a dynamoelectric machine, electrically connected to a first multiple phase bus;

a first multiple phase rectifier;

a second multiple phase rectifier;

a pair of DC link conductors;

means for electrically connecting said first and second multiple phase rectifiers to said DC link conductors;

an inverter for converting a DC voltage on said DC link conductors to a floating multiple phase AC voltage on a second multiple phase bus;

a transformer for converting said floating, multiple phase AC voltage on said second multiple phase bus, to a ground-referenced, multiple phase AC voltage, and for converting an externally supplied three phase AC voltage to a pair of phase displaced three phase voltages;

means for alternatively connecting said first multiple phase bus to at least one of said multiple phase rectifiers for generator operation of said dynamoelectric machine, or for connecting said first multiple phase bus to said second multiple phase bus for starter operation of said dynamoelectric machine; and means for alternatively connecting said transformer to said second multiple phase bus for generator operation of said dynamoelectric machine, or for connecting a first one of said phase displaced three phase voltages to said first multiple phase rectifier and for connecting a second one of said phase displaced three phase voltages to said second multiple phase rectifier for starter operation of said dynamoelectric machine.

2. A variable speed, constant frequency starter/generator system as recited in claim 1, wherein:

said first and second phase displaced three phase voltages are separated by thirty electrical degrees.

3. A starter/generator system as recited in claim 1, wherein said transformer comprises:

a main winding including three wye-connected coils; and an auxiliary winding including a plurality of center tapped coils, each having a center tap connected to one end of one of said main winding coils during starter operation of said dynamoelectric machine.

4. A starter/generator system as recited in claim 1, wherein said means for electrically connecting said first and second multiple phase rectifiers to said DC link conductors comprises:

a first interphase transformer having a winding electrically connected between positive outputs of said first and second multiple phase rectifiers and having a tap point electrically connected to a first one of said DC link conductors; and a second interphase transformer having a winding electrically connected between negative outputs of said first and second multiple phase rectifiers and having a tap point electrically connected to a second one of said DC link conductors.

5. A variable speed, constant frequency starter/generator system comprising:

a dynamoelectric machine, electrically connected to a first multiple phase bus;

a pair of DC link conductors;

a first multiple phase rectifier electrically connected between said first multiple phase bus and said pair of DC link conductors;

a second multiple phase rectifier;

a third multiple phase rectifier;

means for electrically connecting said second and third multiple phase rectifiers to said DC link conductors;

an inverter for converting a DC voltage on said DC link conductors to a floating multiple phase AC voltage on a second multiple phase bus;

a transformer for converting said floating, multiple phase AC voltage on said second multiple phase bus, to a ground-referenced, multiple phase AC voltage, and for converting an externally supplied three phase AC voltage to a pair of phase displaced three phase voltages;

means for electrically connecting said first multiple phase bus to said second multiple phase bus for starter operation of said dynamoelectric machine; and means for alternatively connecting said transformer to said second multiple phase bus for generator operation of said dynamoelectric machine, or for connecting a first one of said phase displaced three phase voltages to said second multiple phase rectifier and for connecting a second one of said phase displaced three phase voltages to said third multiple phase rectifier for starter operation of said dynamoelectric machine.

6. A variable speed, constant frequency starter/generator system as recited in claim 5, wherein:

said first and second phase displaced three phase voltages are separated by thirty electrical degrees.

7. A starter/generator system as recited in claim 5, wherein said transformer comprises:

a main winding including three wye connected coils; and an auxiliary winding including a plurality of center tapped coils, each having a center tap connected to one end of one of said main winding coils during starter operation of said dynamoelectric machine.

8. A starter/generator system as recited in claim 5, wherein said means for electrically connecting said second and third multiple phase rectifiers to said DC link conductors comprises:

a first interphase transformer having a winding electrically connected between positive outputs of said second and third multiple phase rectifiers and having a tap point electrically connected to a first one of said DC link conductors; and a second interphase transformer having a winding electrically connected between negative outputs of said second and third multiple phase rectifiers and having a tap point electrically connected to a second one of said DC link conductors.

9. A method for operating a variable speed, constant frequency starter/generator system comprising the steps of:

connecting a dynamoelectric machine to a first multiple phase bus;

electrically connecting a first multiple phase rectifier to a pair of DC link conductors;

electrically connecting a second multiple phase rectifier to said DC link conductors;

converting a DC voltage on said DC link conductors to a floating multiple phase AC voltage on a second multiple phase bus;

using a transformer to convert said floating, multiple phase AC voltage on said second multiple phase bus, to a ground-referenced, multiple phase AC voltage, and to convert an externally supplied three phase AC voltage to a pair of phase displaced three phase voltages;

alternatively connecting said first multiple phase bus to at least one of said multiple phase rectifiers for generator operation of said dynamoelectric machine, or connecting said first multiple phase bus to said second multiple phase bus for starter operation of said dynamoelectric machine; and alternatively connecting said transformer to said second multiple phase bus for generator operation of said dynamoelectric machine, or connecting a first one of said phase displaced three phase voltages to said first multiple phase rectifier and for connecting a second one of said phase displaced three phase voltages to said second multiple phase rectifier for starter operation of said dynamoelectric machine.

10. A method for operating a variable speed, constant frequency starter/generator system as recited in claim 9, wherein:

said first and second phase displaced three phase voltages are separated by thirty electrical degrees.

11. A method for operating a variable speed, constant frequency starter/generator system comprising the steps of:

connecting a dynamoelectric machine to a first multiple phase bus;

electrically connecting a first multiple phase rectifier between said first multiple phase bus and a pair of DC link conductors;

electrically connecting second and third multiple phase rectifiers to said pair of DC link conductors in a twelve pulse configuration;

converting a DC voltage on said DC link conductors to a floating multiple phase AC voltage on a second multiple phase bus;

using a transformer to convert said floating, multiple phase AC voltage on said second multiple phase bus, to a ground-referenced, multiple phase AC voltage, and to convert an externally supplied three phase AC voltage to a pair of phase displaced three phase voltages;

connecting said first multiple phase bus to said second multiple phase bus for starter operation of said dynamoelectric machine; and alternatively connecting said transformer to said second multiple phase us for generator operation of said dynamoelectric machine, or connecting a first one of said phase displaced three phase voltages to said second multiple phase rectifier and for connecting a second one of said phase displaced three phase voltages to said third multiple phase rectifier for starter operation of said dynamoelectric machine.

12. A method for operating a variable speed, constant frequency starter/generator system as recited in claim 11, wherein:

said first and second phase displaced three phase voltages are separated by thirty electrical degrees.

13. A method for operating a starter/generator system comprising, for a generating mode of operation, the steps of:

a. rectifying a multiple phase, variable frequency AC output voltage from an externally driven, variable speed dynamoelectric machine to produce a first DC voltage;

b. using an inverter to convert said first DC voltage to a floating, three phase, constant frequency AC voltage;

c. connecting said floating three phase, constant frequency AC voltage to a three phase wye-connected winding of a neutral forming transformer to produce a ground-referenced, three phase AC output voltage; and d. supplying said ground referenced, three phase AC output voltage to an external load; and for a starting mode of operation, the steps of:

a. supplying an external three phase AC voltage to said wye-connected winding of said neutral forming transformer;

b. using additional windings of said neutral forming transformer to produce a six phase AC output voltage from said neutral forming transformer;

c. rectifying said six phase AC output voltage to produce a second DC voltage;

d. using said inverter to convert said second DC voltage to a controllable frequency AC voltage; and e. driving said dynamoelectric machine with said controllable frequency AC voltage.

14. A method for operating a starter/generator system as recited in claim 13, wherein said step of using additional windings of said neutral forming transformer to produce a six phase AC output voltage from said neutral forming transformer, comprises the step of:

connecting a center tap point of each of three coils in said additional windings to a first end of each of three coils in said wye-connected windings.

* * * * *